United States Patent [19]

Rehmat et al.

[11] Patent Number: 4,544,375

[45] Date of Patent: Oct. 1, 1985

[54] APPARATUS AND PROCESS FOR CONTROLLING FLUIDIZED BEDS

[75] Inventors: Amirali G. Rehmat, Westmont; Jitendra G. Patel, Bolingbrook, both of Ill.

[73] Assignee: Institute of Gas Technology, Chicago, Ill.

[21] Appl. No.: 555,047

[22] Filed: Nov. 25, 1983

[51] Int. Cl.[4] ..... C10J 3/54

[52] U.S. Cl. ..... 48/197 R; 48/202; 48/206; 48/210; 110/347; 423/659; 423/DIG. 16; 34/10

[58] Field of Search ..... 48/197 R, 202, 206, 48/210; 201/31; 423/659, DIG. 16; 34/10; 110/347

[56] References Cited

U.S. PATENT DOCUMENTS

| | | | |
|---|---|---|---|
| 3,322,521 | 5/1967 | Cockerham | 48/197 R |
| 3,935,825 | 2/1976 | Mathews et al. | 423/DIG. 16 |
| 3,957,459 | 5/1976 | Mitchell et al. | 201/31 |
| 4,229,289 | 10/1980 | Victor | 48/210 |
| 4,309,194 | 1/1982 | Salvador et al. | 48/210 |

*Primary Examiner*—Peter Kratz

*Attorney, Agent, or Firm*—Thomas W. Speckman

[57] ABSTRACT

An apparatus and process for control and maintenance of fluidized beds under non-steady state conditions. An ash removal conduit is provided for removing solid particulates from a fluidized bed separate from an ash discharge conduit in the lower portion of the grate supporting such a bed. The apparatus and process of this invention is particularly suitable for use in ash agglomerating fluidized beds and provides control of the fluidized bed before ash agglomeration is initiated and during upset conditions resulting in stable, sinter-free fluidized bed maintenance.

17 Claims, 2 Drawing Figures

APPARATUS AND PROCESS FOR CONTROLLING FLUIDIZED BEDS

The U.S. Government has a paid-up license in this invention and the right in limited circumstances to require the patent owner to license others on reasonable terms as provided for by the terms of Contract No. DE-AC02-77ET-13046 awarded by the U.S. Department of Energy.

BACKGROUND OF THE INVENTION

1. Field of the Invention

This invention relates to an apparatus and process for control and maintenance of fluidized beds under non-steady state conditions. The desired control and maintenance of the fluidized bed of an ash agglomerating type is achieved by monitoring the ash content in the fluidized bed and providing a removal system dependent only upon the fluidized bed ash content for reduction of ash content of the fluidized bed in order to maintain desired control of fluidization. The controlled process of this invention provides stable, sinter-free fluidized bed operations before ash agglomeration is initiated and during upset conditions.

2. Description of the Prior Art

Fluidized bed processes as well known by the prior art in regard to their utility in converting solids to liquid and gaseous fuels. Ash agglomerating fluidized beds are taught by U.S. Patent Nos. 3,935,825; 4,057,402; 4,229,289; and 4,369,045. In all of the processes taught by these patents, the removal of solids by downward passage through a Venturi withdrawal conduit in the lower portion of the grate supporting the fluidized bed is controlled by the velocity of upward flow of gas to the fluidized bed. The teachings of these disclosures are incorporated herein by reference. The above patents illustrate the importance of providing sufficient removal of agglomerated ash from fluidized bed coal gasifiers during steady state operations. Removal of ash provides additional working surface area and volume for solids conversion.

U.S. Pat. No. 4,099,933 teaches the necessity of maintaining char inventory in a coal gasifier fluidized bed to maintain desired balance between exothermic and endothermic reactions and teaches removal of ash and char through a straight conduit in the lowermost portion of the fluidized bed supporting grate. The U.S. Pat. No. 4,099,933, however, is not concerned with ash removal from an ash agglomerating fluidized bed.

It is also known to control the height of a fluidized bed by overflow pipes which control only the maximum volume of the bed and do not allow controlled withdrawal of solid particulates from the fluidized bed based upon the bed content of a specific particulate.

Removal of ash from a fluidized bed during start up or non-steady state conditions of an ash agglomerating fluidized bed is of particular importance. It is during start up conditions or non-steady state upset conditions where control of the ash content of a fluidized bed becomes critical since the ash may sinter and cause defluidization of the bed. When this happens, the process must be shut down and the bed cleaned out. When ash levels reach a threshold concentration and where the fluidized bed conditions, such as bed temperature and oxidant gas concentration are appropriate, the ash particulates exhibit the propensity to sinter. Sintering of the ash disrupts the intended steady state balance of the system and significant amounts of sinter formation adversely affects the fluidization characteristics of the fluidized bed and may cause complete bed defluidization resulting in the shutdown of the entire process. Different coals, or other carbonaceous solids, result in differing ash contents and chemical characteristics which sinters under differing fluidized bed conditions, such as temperature. It is, therefore, desirable to provide a means to control the conditions within the fluidized bed to prevent sintering by a monitoring and rapid adjustment to provide a process adaptable to a wide variety of fluidized bed reactor vessels.

SUMMARY OF THE INVENTION

The process for controlling ash in a fluidized bed during non-steady state operating conditions involves the steps: measuring the ash content, relative to the carbon content, of the fluidized particulates within the fluidized bed, opening ash removal valve means in an ash removal conduit when the ash content measurement exceeds a first predetermined amount, removing ash through the removal conduit from the fluidized bed and continuing measurement of the ash content within the fluidized bed, and closing the ash removal valve means when the continuing measurement of ash content is reduced to a second predetermined amount suitable for providing continued steady state operating conditions of the fluidized bed. While the process is suitable for use in any type of fluidized bed, it is particularly important in its application to controlling of ash in an ash agglomerating fluidized bed during the conduct of oxidation, such as liquefaction or gasification, of any carbonaceous materials, such as those selected from the group consisting of coal, peat, lignite, petroleum coke, solid waste and wood waste. During steady state process conditions, ash agglomerates at desired rates and free falls through a Venturi shaped ash discharge conduit in the lower portion of the fluidized bed supporting grate. Increase of agglomerate removal may be achieved by varying the upflowing gas, which is generally a reactant or oxidant and also affects the fluidizing of the bed. Further, variance of the velocity of the upflowing gas through the Venturi ash discharge conduit can effect a very limited change in the ash discharge.

This invention provides ash removal independent of agglomerate removal and does not affect fluidizing gas flow. Further, the process of this invention provides measurement of ash relative to carbon in the carbonaceous particles of the fluidized bed and removal of material from the bed at any suitable rate which is sufficient to effect prompt desired ash content control in the fluidized bed.

This invention involves an apparatus for conduct of oxidation or gasification reaction of solid particulates maintained in a fluidized bed of the type supported upon a grate and having an ash discharge conduit in its lower portion wherein an ash content measurement means capable of measurement of the ash content in the fluidized bed controls an ash removal valve means permitting large volume ash removal through an ash removal conduit in communication with the fluidized bed. The ash content measurement means is in communication with a control means opening the ash removal valve means when the measurement means indicates an ash content within the fluidized bed exceeding a first predetermined amount and closing the ash removal valve means when the measurement means indicates an ash content within the fluidized bed is reduced to a second predetermined amount. In a preferred embodiment, the feed rate of carbonaceous solids is increased during removal of solids from the fluidized bed to increase the proportion of carbon in the fluidized bed.

It is an object of this invention to provide a process and apparatus for removal of ash from a fluidized bed during non-steady state conditions to prevent ash sintering and fluidized bed defluidization.

It is another object of this invention to provide a process and apparatus providing removal of ash from the fluidized bed without affecting fluidizing gas flow or reactant gas input.

It is yet another object of this invention to provide a process and apparatus which reduces the ash content of a fluidized bed when predetermined ash contents are attained in a manner which does not significant affect the continuous operation of a fluidized bed gasifier.

It is yet another object of this invention to provide a process and apparatus which may be easily retrofitted to an existing fluidized bed reactor of a wide variety of designs.

BRIEF DESCRIPTION OF THE DRAWING

The above and other objects and advantages of this invention will become more apparent upon reading the description of preferred embodiments together with the drawing wherein.

DESCRIPTION OF THE PREFERRED EMBODIMENTS

Figure 1:
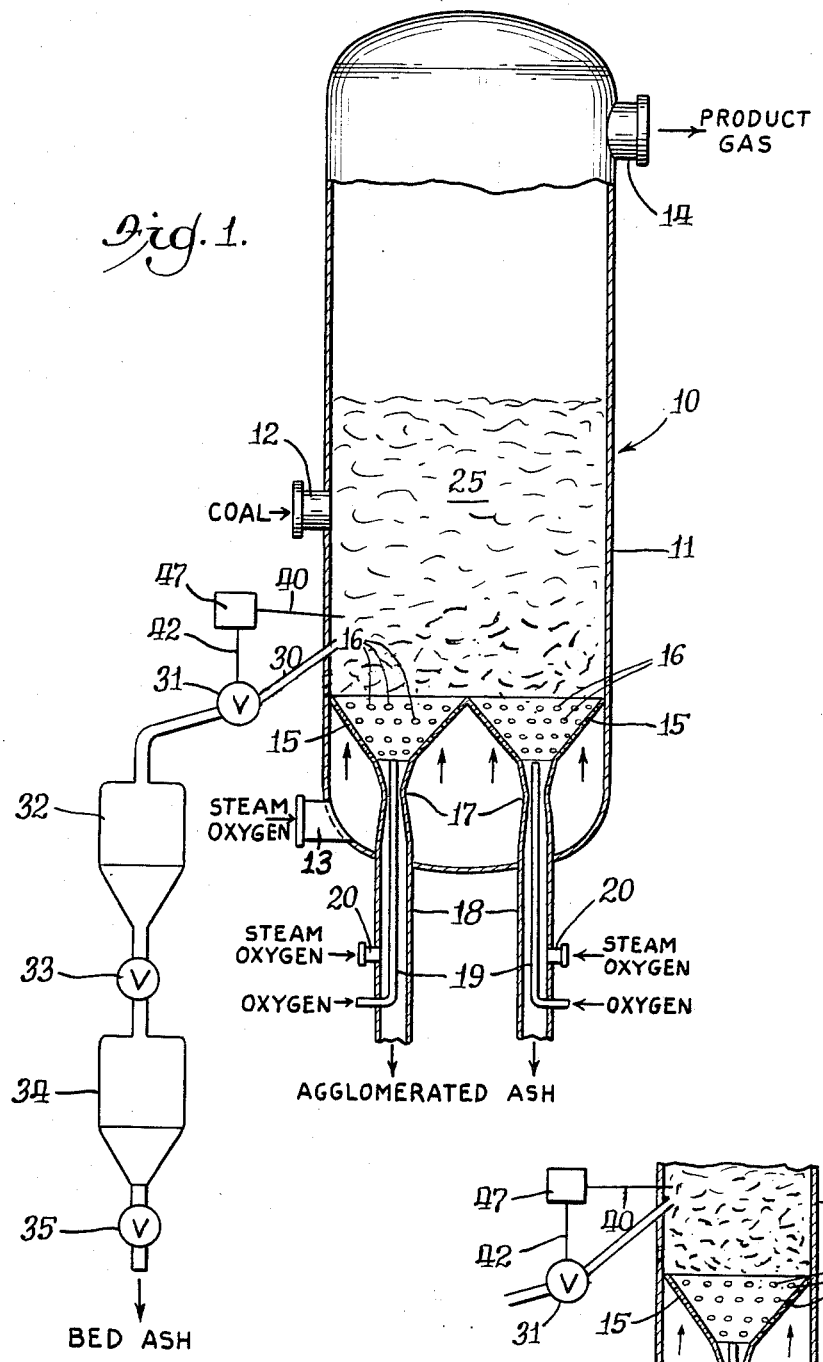
FIG. 1 is a schematic partially sectioned side view of an apparatus according to one embodiment of this invention.

FIG. 1 shows fluidized bed gasifier 10 with pressurized reactor vessel 11, fuel inlet port 12, fluidizing gas inlet port 13, and product gas exit port 14. Small particulate carbonaceous material, such as coal, is introduced to fluidized bed 25 through fuel inlet port 12. The fluidized bed is supported upon conical grates 15 having fluidizing gas ports 16 sufficient to maintain desired fluidization of fluidized bed 25. The fluidized bed supporting grates shown in FIG. 1 are ash agglomerating type grates as more fully described in U.S. Pat. No. 4,229,289. The lower portion of the sloping grates have agglomerated ash removal conduits 18 with narrow necked regions 17. Gas is introduced to agglomerated ash withdrawal conduits 18 through inlet ports 20, below necked region 17, and passes upwardly into the fluidized bed, the rate of flow of the gas through necked regions 17 controlling the removal of ash agglomerates downwardly. Oxidant introduction conduits 19 may be provided in the central portion of agglomerated ash withdrawal conduits 18 to provide a high concentration of oxidant in the ash agglomerating volume of the fluidized bed above the agglomerated ash withdrawal conduits 18. Thus, it is seen that the maintenance of the fluidized bed in fluidized condition is principally achieved by reactant or non-reactant gases or mixtures thereof passing upwardly through fluidizing gas ports 16 and removal of agglomerated ash is principally controlled by reactant or non-reactant gas flowing upwardly through necked region 17 of agglomerated ash withdrawal conduits 18. Thus, at steady state operation there is a balance between the input of fresh carbonaceous material, input of fluidizing and reactant gases, and withdrawal of agglomerated ash. However, when the chemical composition or particulate size of incoming carbonaceous materials changes, or when the flow of either fluidizing gases or oxidant gases changes, or when removal of agglomerated ash changes, or when oxidation or gasification properties of the carbonaceous material changes, upset conditions in the fluidized bed occur and temperature conditions within the fluidized bed may increase and/or ash content of the bed may increase to a point where sintering of the ash takes place causing blockage of incoming gases and/or agglomerated ash removal resulting in eventual defluidization of the fluidized bed. Non-steady state conditions are also present during start-up of the fluidized bed reactor since a suitable ash inventory must be built up to obtain desired agglomeration and agglomerated ash removal steady state conditions. It is during these periods of non-steady state operation that the present invention is particularly useful. The general operation of fluidized bed oxidation or gasification of particulate carbonaceous materials in both non-agglomerating and agglomerating ash removal fluidized bed gasifiers is well known to the art.

This invention provides an apparatus and process for controlling ash content, during non-steady state operating conditions in a fluidized bed in which an oxidation or gasification reaction is being conducted. An ash content measurement means is provided for measurement of fluidized bed ash content, relative to the carbon content of the fluidized particles within the fluidized bed. Dependent primarily upon the properties of the carbonaceous materials used and the operating conditions of the fluidized bed, suitable ratios of ash to carbon are known or may be readily ascertained. The first and second predetermined amounts referred to hereinafter are above and below these ratios by amounts determined desirable in accordance with properties of the fluidized oxidation or gasification system. The ash content measurement means comprises measurement probe 40, shown schematically in FIGS. 1 and 2, in communication with measurement means 47. The ash content of the fluidized bed may be measured by measurement probe 40 according to any suitable method, such as by measurement of average density of fluidized bed particulates. One preferred means for measurement of ash content involves continuously measuring, by measurement probe 40, the pressure drop across a specified height within the fluidized bed. The pressure drop across the specified height within the fluidized bed increases as the ash content, relative to the carbon content of the bed, increases. Such a measurement by measurement probe 40 is a simple measurement which may provide a continuous monitoring of the ash content of the fluidized bed and provide a signal relative to that measurement to measurement means 47. Measurement means 47 is in communication by communication means 42 with valve 31 in ash removal conduit 30. Ash removal conduit 30 has an open end in the fluidized bed and is capable of rapid removal of particulate materials from the fluidized bed independent of fluidizing gas flow or oxidant gas flow. Measurement probe 40 and the open end of ash removal conduit 30 may be located at any region within the fluidized bed which has a typical composition, that is, preferably, away from the particulate inlet port or any fluidizing gas or reactant gas inlet ports. Upon measurement means 47 detecting an ash content measurement exceeding a first predetermined amount, valve 31 is opened for removal of particulates from the fluidized bed and measurement of the ash content within the fluidized bed continued while the particulates are being removed. Upon reduction of the ash content in the fluidized bed to a second predetermined amount, valve 31 is closed and steady state operating conditions continued within the fluidized bed. Measurement means 47 may be any device known to the art capable of analyzing electrical signals from measurement probe 40 and activating valves in the above described manner by electric, mechanical, or any combination of these means. Suitable devices are known to the art. During the period of particulate withdrawal from the fluidized bed by ash withdrawal conduit 30, addition of fresh carbonaceous particulates to the fluidized bed through inlet conduit 12 is continued thereby decreasing the relative ash content of the fluidized bed. The addition of fresh carbonaceous feed particulates through inlet conduit 12 may be increased during the ash withdrawal cycle to more rapidly increase the relative organic carbon content of the fluidized bed.

Since the fluidized bed is generally operated under pressurized conditions, ash withdrawal conduit 30 empties into a first lockhopper 32 which is serially connected with a second lockhopper 34 through valve 33 for discharge from lockhopper 34 through valve 35 at atmospheric pressure. Operation of lockhopper 32 and lockhopper 34 may be cycled as necessary to remove solids from a pressurized fluidized bed in known methods for as small pressure loss as reasonable.

Figure 2:
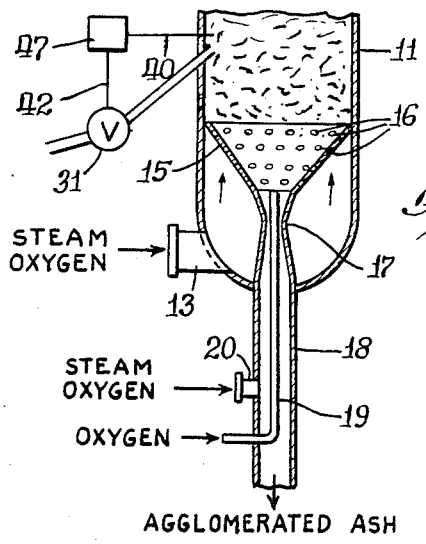
FIG. 2 is a schematic partially sectioned side view of a portion of another apparatus according to another embodiment of this invention.

It is readily apparent that this invention may be practiced with multiple withdrawal conduits 30 having openings in different locations in the fluidized bed and controlled by valve 31. It is also readily apparent that the invention, being especially suitable for use with ash agglomerating fluidized reactors, may be used with such reactors having grates with multiple agglomerated ash withdrawal conduits 18 as shown in FIG. 1 or with a single agglomerated ash withdrawal conduit as shown in FIG. 2.

The first predetermined amount of fluidized bed ash content is that ash content just below the ash content at which sintering takes place under the composition and reaction conditions existing in the reactor. It is readily apparent that the quantification of the first predetermined amount of ash content depends upon the carbonaceous material being fed to the reactor as solid particulates and upon chemical compositions and temperatures within the fluidized bed. These ash content amounts can be readily ascertained by known values or by trial and error experience with particular materials under specified reactor conditions. Upon reaching the first predetermined amount of fluidized bed ash content, the ash content of the fluidized bed is lowered by removal of bed particulates through the ash removal conduit provided by this invention to a second and lower predetermined amount of ash content in the fluidized bed. As pointed out above, this may be hastened by increase of the carbonaceous feed to the fluidized bed during ash withdrawal. The second predetermined amount of ash content of the fluidized bed may also be readily ascertained by one skilled in the art depending upon the physical and chemical characteristics of the system.

In one preferred embodiment of this invention, measurement means 47 may also be in communication with the means for supplying carbonaceous particulates through inlet conduit 12 and the supply of fresh particulates may be increased during the time of particulate withdrawal from the fluidized bed, thereby decreasing the time interval necessary for withdrawal of bed particulates through withdrawal conduit 30 to reach the reduced second predetermined ash content. This gives even further control over the ash content in the fluidized bed during sudden non-steady state conditions.

The following Examples are set forth to show the advantages of the apparatus and process of this invention and are not meant to limit the invention in any way.

EXAMPLE I

A gasifier incorporating ash removal apparatus of this invention shown in FIG. 2 was operated under variable temperature and fluidization conditions to show the effect of utilization of ash removal apparatus and process of this invention. The fluidized bed volume was nominally 30 cubic feet and solids inlet feed rates of 900 to 2200 pounds per hour could be obtained. The ash removal conduit was a 3 inch diameter pipe extending into the fluidized bed. The system was sized to remove up to 500 pounds of fluidized bed solids per hour to accommodate carbonaceous solids of varying compositions and a variety of operating conditions. The withdrawal system comprised two lockhoppers as shown in FIG. 1 wherein the control valves operated in open and closed preset cycles to remove bed solids. The valves were electromechanically controlled by bed density which was determined by measurement of pressure drop across a specified distance in the fluidized bed. This method of ascertaining fluidized bed composition, that is, the ratio between ash and organic carbon was confirmed by chemical analysis of solids removed from the fluidized bed at various times.

Run-of-mine western Kentucky coal of particle size range of less than ¼ inch and 61 pounds per cubic foot density was fed to a fluidized bed maintained under gasification conditions at a constant rate of 1200 pounds per hour. Fluidizing velocity was maintained at about 3.4 ft/sec. and the fluidized bed maintained at a temperature of 1900° F. Coal ash accumulated in two hours of operation, and prior to initiation of ash agglomeration, to 67 weight percent of the fluidized bed particulates and the ash sintered resulting in bed defluidization at two hours of operation. The ash removal conduit was not operated during this run.

EXAMPLE II

When utilizing ash measurement and removal of ash from the fluidized bed independent from agglomerated ash withdrawal to maintain ash concentration indicated with the same apparatus and coal described in Example I prior to steady state ash agglomeration conditions, operation was conducted for the conditions and times below:

| Temp. °F. | Fluidization Vel. ft/sec. | Ash Concentration Maintained (weight percent) | Time Fluidized Bed Maintained (Hours) |
|---|---|---|---|
| 1850 | 4 | 50 | 30 |
| 1850 | 4 | 50 | 38 |
| 1875 | 4.2 | 70 | 26* |
| 1890 | 4.2 | 60 | 30* |
| 1900 | 4 | 60 | 168 |

*Steady state fluidization continued with agglomerated ash withdrawal.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for maintaining fluidization during non-steady state operating conditions of a fluidized bed comprising solid carbonaceous materials for oxidation or gasification reactions comprising the steps: measuring the ash content relative to carbon content of fluidized solid carbonaceous materials within said fluidized bed; opening ash removal valve means in an ash removal conduit when said ash content measurement exceeds a first predetermined amount which is above a suitable ratio of ash to carbon and below the ash content at which sintering takes place and removing solid particulates comprising ash from said fluidized bed through said removal conduit while maintaining said solid carbonaceous material input; and continuing measurement of ash content within said fluidized bed and closing said ash removal valve means when said continuing measurement of ash content is reduced to a second predetermined amount which is below said suitable ratio of ash to carbon, providing controlled fluidization of said fluidized bed.

2. The process of claim 1 wherein the rate of said carbonaceous material input is increased during said ash removal.

3. The process of claim 2 wherein said solid carbonaceous material is coal.

4. The process of claim 2 wherein said solid carbonaceous material is selected from the group consisting of coal, peat, lignite, petroluem coke, solid waste and wood waste.

5. The process of claim 4 wherein said fluidized bed is an ash agglomerating fluidized bed wherein gas flow controlling agglomerate removal is independent of said ash removal.

6. The process of claim 5 wherein said ash removal is independent of said agglomerate removal.

7. The process of claim 1 wherein said fluidized bed is an ash agglomerating fluidized bed wherein gas flow controlling agglomerate removal is independent of said ash removal.

8. The process of claim 1 wherein said solid carbonaceous material is selected from the group consisting of coal, peat, lignite, petroleum coke, solid waste and wood waste.

9. In a process for controlling ash content in a fluidized bed comprising solid carbonaceous materials undergoing oxidation or gasification during non-steady state operating conditions the improvement comprising the steps: measuring the ash content relative to carbon content of fluidized solid carbonaceous materials within said fluidized bed; opening ash removal valve means in an ash removal conduit when said ash content measurement exceeds a first predetermined amount which is above a suitable ratio of ash to carbon and below the ash content at which sintering takes place and removing solid particulates comprising ash from said fluidized bed through said removal conduit while maintaining said solid carbonaceous material input; continuing measurement of ash content within said fluidized bed and closing said ash removal valve means when said continuing measurement of ash content is reduced to a second predetermined amount which is below said suitable ratio of ash to carbon, providing controlled ash content of said fluidized bed.

10. The process of claim 9 wherein the rate of said solid carbonaceous material input is increased during said ash removal.

11. The process of claim 10 wherein said solid carbonaceous material is coal.

12. The process of claim 9 wherein said solid carbonaceous material is selected from the group consisting of coal, peat, lignite, petroleum coke, solid waste and wood waste.

13. The process of claim 12 wherein said fluidized bed is an ash agglomerating fluidized bed wherein gas flow controlling agglomerate removal is independent of said ash removal.

14. The process of claim 12 wherein said ash removal is independent of said agglomerate removal.

15. The process of claim 9 wherein said fluidized bed is an ash agglomerating fluidized bed wherein gas flow controlling agglomerate removal is independent of said ash removal.

16. The process of claim 9 wherein said solid carbonaceous material is coal.

17. The process of claim 9 wherein said ash content measurement comprises measuring pressure drop across a specified distance in said fluidized bed.

* * * * *